US005763015A

United States Patent [19]

Hasui et al.

[11] Patent Number: 5,763,015

[45] Date of Patent: Jun. 9, 1998

[54] METHOD FOR SEALING A SPRAY COATING AND SEALING MATERIAL

[75] Inventors: Kenji Hasui; Toshiaki Arakawa; Kazuyoshi Tsuneta, all of Nishinasuno-machi, Japan

[73] Assignee: Dai Nippon Toryo Co., Ltd., Osaka, Japan

[21] Appl. No.: 739,290

[22] Filed: Oct. 29, 1996

[30] Foreign Application Priority Data

Oct. 31, 1995 [JP] Japan ..... 7-282903

[51] Int. Cl.[6] ..... B05D 1/08; B05D 1/36; B05D 3/10

[52] U.S. Cl. ..... 427/449; 427/203; 427/205; 427/341; 427/421

[58] Field of Search ..... 427/203, 205, 427/328, 341, 406, 426, 449, 446, 421, 337

[56] References Cited

U.S. PATENT DOCUMENTS

| | | | |
|---|---|---|---|
| 3,954,511 | 5/1976 | Kado et al. | 148/6.15 R |
| 4,098,749 | 7/1978 | Hoshino et al. | 260/30.6 R |
| 4,971,838 | 11/1990 | Hamamura et al. | 427/422 |
| 5,077,332 | 12/1991 | Blatter et al. | 524/389 |
| 5,341,562 | 8/1994 | Furuya et al. | 29/825 |

FOREIGN PATENT DOCUMENTS

| | | |
|---|---|---|
| 0 275 083 | 7/1988 | European Pat. Off. . |
| WO 94/19640 | 9/1994 | WIPO . |

*Primary Examiner*—Shrive Beck
*Assistant Examiner*—Fred J. Parker
*Attorney, Agent, or Firm*—Oblon, Spivak, McClelland, Maier & Neustadt, P.C.

[57] ABSTRACT

A method for sealing a zinc-aluminum pseudo alloy spray coating, which comprises forming a zinc-aluminum pseudo alloy spray coating on a substrate to be spray-coated, and then sealing the surface of the coating with a chromium-free sealing material containing phosphoric acid in an amount of from 0.1 to 7 wt %.

4 Claims, No Drawings

METHOD FOR SEALING A SPRAY COATING AND SEALING MATERIAL

The present invention relates to a method for sealing a zinc-aluminum pseudo alloy spray coating formed on a substrate made of various metal material, inorganic material or plastic material, and a sealing material suitable for a metal spray coating, particularly for a zinc-aluminum pseudo alloy spray coating.

The zinc-aluminum pseudo alloy spray coating is a spray coating wherein zinc and aluminum do not form an alloy structure, but sprayed zinc fine particles and aluminum fine particles are randomly piled on one another, so that they may appear to form a zinc-aluminum alloy. A method for forming such a zinc-aluminum pseudo alloy spray coating is disclosed in e.g. U.S. Pat. No. 4,971,838 or Japanese Examined Patent Publication No. 56424/1990.

Such a zinc-aluminum pseudo alloy spray coating makes a dense and stable coating by a self sealing effect, and when formed on a metal substrate such as a steel substrate, it exhibits an excellent long lasting corrosion preventing property by synergistic effects of the barrier effect and the sacrificial corrosion preventing effect. Accordingly, it has been widely used.

However, the zinc-aluminum pseudo alloy spray coating is porous immediately after spraying, like other metal spray coatings, and if it is wetted with sea water or the like before it becomes a dense coating by self sealing, such sea water or the like penetrates to the substrate, whereby the spray coating will be corroded, and hydrogen gas will be generated.

Under such a situation, the surface layer of the spray coating will also be corroded, so that self sealing rapidly proceeds, whereby hydrogen gas generated inside the spray coating, can not diffuse to the exterior, which causes a phenomenon wherein the spray coating undergoes blistering from a portion where the adhesive strength of the coating is low. This tendency is remarkable as the spray coating is thick, and there has been a problem that the blistered spray coating is susceptible to peeling.

Under the circumstances, the present inventors formed a zinc-aluminum pseudo alloy spray coating and subjected it to sealing treatment with a common epoxy resin-type sealing material or chromium-containing sealing material. With the former sealing material, the blistering phenomenon of the spray coating was reduced to some extent, but the same phenomenon still often occurred. With the latter sealing material, it was possible to prevent the blistering phenomenon, but it contains chromium, whereby there was a toxicity problem, and there were additional problems such that the water resistance decreased, and the coating tended to be colored.

In another method, the zinc-aluminum pseudo alloy spray coating was immersed in water to permit self sealing under a mild corrosive environment, whereby no blistering phenomenon of the spray coating occurred, but it took a long time for self sealing. Thus, such a method was not practical.

It is an object of the present invention to solve such problems of the conventional methods for sealing a spray coating and to provide a method for sealing a zinc-aluminum pseudo alloy spray coating, whereby the blistering phenomenon of the spray coating is prevented, and self sealing treatment can be carried out in a short period of time without toxicity or without deteriorating the property such as water resistance.

Another object of the present invention is to provide a sealing material for a metal spray coating, which is useful for such a sealing method.

The present inventors have conducted a research to solve the above problems and as a result, have found that when sealing treatment is carried out with a chromium-free sealing material containing phosphoric acid, the spray coating can be self-sealed in a short period of time without the blistering phenomenon of the spray coating. The present invention has been accomplished on the basis of this discovery.

Thus, the present invention provides a method for sealing a zinc-aluminum pseudo alloy spray coating, which comprises forming a zinc-aluminum pseudo alloy spray coating on a substrate to be spray-coated, and then sealing the surface of the coating with a chromium-free sealing material containing phosphoric acid in an amount of from 0.1 to 7 wt %.

Further, the present invention provides a sealing material for a metal spray coating free from chromium, which comprises phosphoric acid in an amount of from 0.1 to 7 wt % and a cationic emulsion resin or a butyral resin as a binder.

Now, the present invention will be described in detail with reference to the preferred embodiments. "The substrate to be metal spray-coated" (hereinafter referred to simply as the substrate) to be used in the method of the present invention, is not particularly limited. For example, it may be an iron material such as a tin plate, a dull finish steel plate, a cold rolled steel plate, a black skin steel plate, a surface-treated rusted steel plate or a welded steel plate; a non-ferrous metal such as aluminum or zinc; a plastic such as ABS, PPO or a polyvinyl chloride; an inorganic material such as a slate, a calcium silicate plate or concrete; and others such as glass, wood, plywood or an organic resin film (coating film).

In the method of the present invention, it is preferred to roughen the substrate surface to provide anchoring effects, prior to metal spraying, in order to improve the adhesion of the substrate surface with the zinc-aluminum pseudo alloy spray coating.

Roughening of the substrate surface may be carried out by a conventional blast treatment such as sand blast treatment or grid blast treatment. However, such a conventional method has a problem that the working environment tends to be poor due to dusting. Accordingly, in the present invention, it is preferred to roughen the substrate surface by forming a porous primer layer by coating thereon a primer containing insoluble solid particles, as disclosed in e.g. U.S. Pat. No. 4,971,838.

Such a primer contains solvent-insoluble solid particles and a resin used as a binder (hereinafter referred to as a binder resin). The solid particles may, for example, be a metal such as steel, nickel, aluminum, zinc, iron or silicon, or an alloy thereof, or an oxide, a nitride or a carbide thereof. More specifically, the solid particles may, for example, be aluminum oxide, silicon oxide (silica sand), iron oxide, silicon carbide or boron nitride. The particle size of the solid particles is preferably from 5 to 200 μm, more preferably from 30 to 100 μm.

It is preferred to mix the solid particles in a proportion of from 25 to 400 parts by volume (from 20 to 80% as the pigment volume concentration (PVC)), preferably from 65 to 150 parts by volume (from 40 to 60% as the pigment volume concentration (PVC)), per 100 parts by volume of the binder resin. If the amount of the solid particles to the binder resin is less than 25 parts by volume, the resin content tends to be so much that the surface roughness tends to be small, and consequently, the adhesion of the metal spray coating tends to be low. Further, the amount of the resin deposited on the substrate increases, and an insulating coating will be formed. Such is not suitable particularly when the spray coating is used for sacrificial corrosion prevention. On the other hand, if the amount of the solid particles to the resin exceeds 400 parts by volume, the resin content tends to be too small, whereby the bonding strength among the solid particles tends to be weak, and consequently, the adhesive force of the metal spray coating tends to be low.

The binder resin is not particularly limited, so long as it is capable of forming a coating film having a certain degree of dryable property and good hardness, adhesion and water resistance. Specific examples include one pack room temperature drying type resins such as a thermoplastic acrylic resin, a vinyl resin, a chlorinated rubber and an alkyd resin; two pack type curable resins such as an unsaturated polyester resin, an acrylic/urethane resin, a polyester/urethane resin and an epoxy resin; and thermosetting resins such as a melamine/alkyd resin, a melamine/acrylic resin, a melamine/polyester resin, an acrylic resin and an acrylic/urethane resin.

To such a primer, an organic solvent, water or the like may be added, as the case requires, to dissolve or disperse the resin, as an additional component other than the above solid particles and binder resin. Further, a dye, a pigment or an additive such as a dispersing agent, a foam-preventing agent, a sag-preventing agent or a thixotropic agent, may be added as the case requires.

Such a primer composition may be in any form such as a non-solvent type, a solvent type, a water-soluble type or a water-dispersible type. The primer is coated on the substrate surface in the same manner as for a usual coating material. It is particularly preferred to employ an air spray method, since it is thereby easy to control the coating amount.

The coating amount of the solid content of the primer is usually within a range of from about 10 to 300 g/m$^2$. The surface of the primer layer thus formed is preferably a rough surface represented by a ratio of Sm/Rz being at most 5, preferably at most 3, where Sm is the average spacing of roughness peaks, and Rz is the ten point height of irregularity, and Rz being from 10 to 250 μm, preferably from 30 to 150 μm. With such a rough surface, the spray deposition efficiency will be improved, and a spray coating having good adhesion can be obtained.

The ten point height of irregularity (Rz) and the average spacing of roughness peaks (Sm) are defined in JIS B-0601 and can readily be evaluated by a feeler-type surface roughness meter. It is difficult to generally define the conditions for forming the rough surface having desired Sm and Rz. However, a desired rough surface can be obtained by preliminarily determining the composition of the primer, the particle size of solid particles, the viscosity of the primer, the coating conditions, etc.

In the present invention, metal spraying is carried out on the substrate surface roughened as described above, to form a zinc-aluminum pseudo alloy spray coating. The zinc-aluminum pseudo alloy spraying coating can be formed by spraying two wire materials selected, for example, from a zinc wire, an aluminum wire and their alloy wire, simultaneously on the substrate by a low temperature metal spraying method by means of a depressurized arc spraying machine.

The low temperature metal spraying method by means of a depressurized arc spraying machine, is a spray method wherein the metal wires are continuously melted by electrical arc in an environment with the pressure more reduced at the central portion than the peripheral portion by means of e.g. a low temperature air stream jetted in a cylindrical form, and at the same time, the melted metals are aspirated to the front jet stream for pulverization and rapid cooling to a temperature around room temperature, whereby melted metal particles will be deposited in a super-cooled liquid state on the substrate. Such a spray method is disclosed in e.g. Japanese Examined Patent Publication No. 24859/1972 and Japanese Unexamined Patent Publication No. 167472/1986.

The method of the present invention is such that in the above spraying method, two wires selected from a zinc wire, an aluminum wire and their alloy wire, are used, and these wires are simultaneously sprayed on the substrate. As mentioned above, "the wires" to be used in the method of the present invention are two wires selected from the group consisting of a zinc wire, an aluminum wire and an alloy wire of zinc and aluminum, and it is possible to use them in various combinations. For example, they may be used in a combination of a zinc wire and an aluminum wire, a zinc/aluminum alloy wire and an aluminum wire, or a zinc/aluminum alloy wire and a zinc wire.

The ratio of zinc to aluminum in the spray coating can be changed by changing the combination of wires, the diameters of the wires or the wire feeding speeds, and such a ratio may be adjusted depending upon the particular purpose or the material of the substrate. For example, when the substrate is steel, the ratio of zinc to aluminum is preferably Zn/Al=90/10 to 50/50 (weight ratio), more preferably 80/20 to 60/40, from the viewpoint of improving the corrosion preventing property.

The coating amount of the spray coating is optionally determined depending upon the type of the substrate or the particular purpose. It is usually from about 150 to 3000 g/m$^2$, preferably from 300 to 2000 g/m$^2$.

As described above, a zinc-aluminum pseudo alloy spray coating is formed on a substrate, and then sealing treatment is carried out by using a chromium-free sealing material containing phosphoric acid in an amount of from 0.1 to 7 wt %. Namely, when the sealing material of the present invention is penetrated into the zinc-aluminum pseudo alloy spray coating, the zinc-aluminum pseudo alloy spray coating will be slightly corroded and stabilized by the influence of phosphoric acid, whereby self sealing will take place, and porous portions will be filled with the binder resin or pigment of the sealing material, so that the zinc-aluminum pseudo alloy spray coating will be sealed.

The sealing material of the present invention is prepared by mixing a binder resin, a solvent capable of dissolving or dispersing the resin, a pigment and phosphoric acid, and if necessary, further adding various additives.

As the resin, various resins for coating materials, such as a butyral resin, an acrylic resin and an epoxy resin, may be employed. Particularly preferred is a butyral resin whereby a quick drying organic solvent can be used; or a cationic emulsion resin whereby water can be used as the solvent and which can be dispersed stably even when phosphoric acid is incorporated, such as a cationic acrylic resin type emulsion resin as disclosed in e.g. Japanese Examined Patent Publication No. 76336/1991 or No. 14037/1993.

The above solvent is not particularly limited so long as it is capable of dissolving or stably dispersing the above resin. Typical examples include various organic solvents including an alcohol type organic solvent such as methanol, ethanol, propanol or butanol; a ketone type organic solvent such as acetone or methyl ethyl ketone; an ester type organic solvent such as methyl acetate or ethyl acetate; an ether type organic solvent such as ethylene glycol monopropyl ether or ethylene glycol monobutyl ether; and a hydrocarbon type organic solvent such as toluene or xylene; water, and a solvent mixture thereof.

As the above pigment, various extenders, coloring pigments and rust-preventive pigments, which are commonly used for coating materials, may be used. Typical examples include calcium carbonate, barium sulfate, magnesium carbonate, silica, titanium oxide, iron oxide, a borate, a condensed zinc phosphate, a condensed aluminum phosphate and a molybdate. However, a chromium type pigment is not desirable for the above-mentioned reason.

As the above additives, a silane coupling agent, a dispersing agent, a penetrating agent, a defoaming agent and a precipitation-preventing agent may be mentioned as typical examples.

The sealing material to be used in the present invention contains phosphoric acid in an amount of from 0.1 to 7 wt %, preferably from 0.5 to 5 wt %. If the amount of phosphoric acid is less than the above range, stabilization by corrosion of the spray coating tends to be inadequate, and self sealing can not be accomplished in a short time. Further, a phenomenon of blistering of the spray coating is likely to occur in a salt spray test, and the effect obtainable by incorporating phosphoric acid tends to be small. On the other hand, if the amount exceeds the above range, the spray coating tends to be remarkably corroded, whereby hydrogen gas is likely to be vigorously generated, and sealing will be incomplete by the foaming, and holes are likely to form, such being undesirable.

The blending proportion of other components of the sealing material may optionally be selected taking into consideration efficiency in impregnation into the spray coating, coating efficiency of the sealing material, etc. As calculated as the solid content, the resin is usually from 20 to 80 wt %, preferably from 30 to 70 wt %, the pigment is from 20 to 80 wt %, preferably from 30 to 70 wt %, and the additive is from 0 to 10 wt %. The solid content of the sealing material is usually from 10 to 70 wt %, preferably from 15 to 50 wt %.

The sealing material can be coated on the surface of the spray coating by means of an air spray, a brush or the like. The spray coating is sealed so that the coating amount of the solid content would be from 5 to 100 g/m$^2$. In the present invention, the zinc-aluminum pseudo alloy spray coating is sealed in such a manner, and if necessary, a top coating material may further be applied.

By the method for sealing the zinc-aluminum pseudo alloy spray coating of the present invention, it is possible to prevent the blistering phenomenon of the spray coating, and it is possible to form a coating excellent in the corrosion resistance, water resistance, etc. in a short period of time.

Now, the present invention will be described in further detail with reference to Examples. However, it should be understood that the present invention is by no means restricted to such specific Examples.

In the following Examples, "parts" and "%" mean "parts by weight" and "% by weight", respectively, unless otherwise specified.

Preparation of Sealing Material A-1

Into a five-necked flask equipped with a stirrer, a heat exchanger, a thermometer and two dropping funnels, 120 parts of deionized water and 2 parts of polyoxyethylene nonylphenyl ether as a nonionic surfactant, were charged and heated to 74° C. Then, 0.5 part of 2,2'-azobis(2-amidinopropane)dihydrochloride as a cationic initiator, was added thereto. Then, while maintaining the temperature of the mixture at 74° C., a mixture comprising 0.2 part of dodecylmercaptan and 96 parts of unsaturated monomers comprising 52 parts of methyl methacrylate, 40 parts of 2-ethylhexyl acrylate and 4 parts of 2-hydroxyethyl acrylate, and a mixture comprising 50 parts of deionized water and 5 parts of an aqueous solution containing 80% of dimethylaminoethylmethyl chloride salt of methacrylic acid as a cationic monomer, were dropwise added, respectively, over a period of 3 hours with stirring, to carry out emulsion polymerization. After completion of the dropwise addition, the temperature was raised to 86° C., followed by aging for 2 hours. Then, the reaction product was cooled to 40° C. and taken out to obtain an aqueous dispersion A having a solid content of 37.0% and an average particle size of the resin of 0.03 μm.

270 Parts of this aqueous dispersion A, 30 parts of ethylene glycol monobutyl ether and 100 parts of titanium oxide white pigment were dispersed by a paint shaker for 30 minutes. Then, 20 parts of an aqueous solution containing 20% of phosphoric acid was added to obtain a sealing material A-1. The sealing material A-1 had a particle size of at most 10 μm, a viscosity (20° C.) of 30 seconds (Ford cup #4) and a solid content of 49% (phosphoric acid content: 0.95%).

Preparation of Sealing Material A-2

A sealing material A-2 was prepared in the same manner as for the sealing material A-1 except that deionized water was used instead of the aqueous phosphoric acid solution (phosphoric acid content: 0%).

Preparation of Sealing material A-3

A sealing material A-3 was prepared in the the same manner as for the sealing material A-1 except that the aqueous dispersion A was 240 parts, the ethylene glycol monobutyl ether was 20 parts, the titanium oxide white pigment was 90 parts, and an aqueous solution containing 50% of phosphoric acid was 70 parts (phosphoric acid content: 8.3%).

Preparation of Sealing Material A-4

Into the above-mentioned flask, 120 parts of deionized water and 3 parts of polyoxyethylene nonylphenyl ether were charged, and the temperature was raised to 74° C. Then, 0.5 part of 2,2'-azobis(2-amidinopropane) dihydrochloride was further added thereto. Then, while maintaining the temperature of the mixture at 740° C., a mixture comprising 0.1 part of dodecylmercaptan and 98 parts of unsaturated monomers comprising 54 parts of methyl methacrylate, 40 parts of butyl acrylate and 4 parts of 2-hydroxyethyl methacrylate, and a mixture comprising 50 parts of deionized water and 2.5 parts of an aqueous solution containing 80% of dimethylaminoethylmethyl chloride salt of methacrylic acid, were dropwise added, respectively, over a period of 3 hours with stirring to carry out emulsion polymerization. After completion of the dropwise addition, the temperature was raised to 86° C., and aging was carried out for 2 hours, and the product was cooled to 40° C.

Then, 10 parts of ethylene glycol monopropyl ether, 15 parts of ethylene glycol monobutyl ether and 120 parts of titanium oxide white pigment were dispersed by a paint shaker for 30 minutes, and 70 parts of an aqueous solution containing 40% of phosphoric acid was added thereto, to obtain a sealing material A-4. The sealing material A-4 had a particle size of at most 10 μm, a viscosity (20° C.) of 35 seconds (Ford cup #4) and a solid content of 51% (phosphoric acid content: 5.7%).

Preparation of Sealing Material B-1

8.8 Parts of a butyral resin, 20 parts of toluene, 15 parts of ethanol, 10 parts of isopropyl alcohol, 10 parts of butanrol, 3 parts of a precipitation-preventing agent and 13.2 parts of titanium oxide white pigment, were dispersed by a paint shaker for 30 minutes. Then, 20 parts of an isopropyl alcohol solution containing 10% of phosphoric acid was added thereto obtain a sealing material B-1. The particle size was at most 15 μm, the viscosity (20° C.) was 45 seconds (Ford cup #4), and the solid content was 23% (phosphoric acid content: 2%).

Preparation of Sealing Material B-2

A sealing material B-2 was prepared in the same manner as for the sealing material B-1 except that isopropyl alcohol was used instead of the isopropyl alcohol solution of phosphoric acid (phosphoric acid content: 0%).

Preparation of Sealing Material B-3

A sealing material B-3 was prepared in the same manner for the sealing material B-1 except that isopropyl alcohol solution containing 10% of phosphoric acid was changed to an isopropyl alcohol solution containing 40% of of phosphoric acid (phosphoric acid content: 8%).

Preparation of Primer A

A monomer composition comprising 400 parts of methyl methacrylate, 500 parts of butyl acrylate, 80 parts of 2-hydroxyethyl methacrylate and 20 parts of methacrylic acid, was subjected to emulsion polymerization using 10 parts of sodium dodecylbenzene sulfonate as an emulsifier and 3 parts of ammonium persulfate as an initiator, to obtain an emulsion having a solid content of 40%. Then, 306 parts (resin content volume: 100) of an acrylic resin emulsion having a solid content of 36% having a neutralizing amine, a film-forming assisting agent, a defoaming agent and a thickener added thereto, and 240 parts (particle volume: 100, PVC: 50%) of silica sand having an average particle size of 100 μm (silica sand OS No. 8, manufactured by Okumura Yogyo Genryo K.K., specific gravity: 2.4) were thoroughly mixed thereto to obtain a primer A.

Preparation of Primer B

80 Parts of xylene, 60 parts of methyl ethyl ketone and 25 parts of butanol were added and dissolved in 100 parts of an epoxy resin ("Epichlon 4051", manufactured by Dainippon Ink Chemical Industry Co., Ltd., epoxy equivalent: 950). Then, 10 parts of a polyamide resin ("Epicure 892", manufactured by Ceranese, active hydrogen equivalent: 133) was added thereto. 275 Parts (resin solid content volume: 100) of the epoxy-polyamide resin having a solid content of 40%, thus obtained, and 221 parts (particle volume: 70, PVC: 41%) of silicon carbide ("Green Silicon Carbide CG320", manufactured by Nagoya Kenmazai Kogyo K.K., specific gravity: 3.16) having an average particle size of 48 μm, were thoroughly mixed to obtain a primer B.

EXAMPLE: 1

On a steel plate of 3.2×70×150 mm treated by shot blasting, the primer A was coated by an air spray in a coating amount of solid content being 60 g/m$^2$ and then dried to form a coating having a surface roughness (Rz) of 110 μm and a ratio of Sm/Rz of 3.0. Then, on the coating surface, a zinc-aluminum pseudo alloy spray coating was formed by means of a depressurized arc spraying machine (PA-100, manufactured by Pan Art Craft Co., Ltd.). The wires used for spraying were a pure zinc wire and a pure aluminum wire each having a diameter of 1.3 mm, and these materials were sprayed at a wire feeding speed of 5 m/min at a voltage of 15 V at an electric current of 130 A under an air pressure of 6 kg/cm$^2$ at a spraying distance of 20 cm. The coating amount of the zinc-aluminum pseudo alloy spray coating thus obtained, was 400 g/m$^2$, and the weight ratio of Zn/Al in the spray coating was 72/28.

Then, on this spray coating surface, the sealing material A-1 was coated by an air spray so that the coating amount of solid content would be 40 g/m$^2$, for sealing treatment.

EXAMPLE 2 and COMPARATIVE EXAMPLES 1 to 3

Sealing treatment was carried out in the same manner as in Example 1 except that instead of the sealing material A-1, the sealing materials A-2, A-3 and A-4 were used respectively. In Comparative Example 3, no sealing treatment was carried out.

EXAMPLE 3

On the above-mentioned steel plate treated by shot blasting, the primer B was coated by an air spray in a coating amount of solid content being 30 g/m$^2$ and then dried to form a coating having a surface roughness (Rz) of 60 μm and a ratio of Sm/Rz of 2.2.

Then, a zinc-aluminum pseudo alloy spray coating having a weight ratio of Zn/Al of 79/21, was formed in the same manner as in Example 1 except that as the aluminum wire, a wire having a diameter of 1.1 mm was used, the voltage was changed to 16 V, and the electric current was changed to 120 A.

Then, on this spray coating surface, the sealing material B-1 was coated by an air spray so that the coating amount of solid content would be 30 g/m$^2$, for sealing treatment.

COMPARATIVE EXAMPLES 4 to 6

Sealing treatment was carried out in the same manner as in Example 3 except that instead of the sealing material B-1, the sealing materials B-2 and B-3 were used respectively. In Comparative Example 6, no sealing treatment was carried out.

With respect to the sample plates obtained in Examples 1 to 3 and Comparative Examples 1 to 6, salt spray tests were carried out for 1000 hours and 4000 hours, respectively. The results are shown in Table 1. As is evident from Table 1, in each of Examples 1 to 3 wherein sealing treatment was carried out by using the sealing materials of the present invention, no abnormality was observed in the salt spray tests, and the coating was excellent in the corrosion preventing property. Whereas, in Comparative Examples 1 and 4 wherein a sealing material containing no phosphoric acid was used, the spray coating underwent blistering and peeling. Further, in Comparative Examples 2 and 5 wherein a sealing material containing phosphoric acid excessively was used, foaming was remarkable at the initial stage of the salt spray tests, and white rust formed. Further, in Comparative Examples 3 and 6, wherein no sealing treatment was carried out, white rust formed remarkably.

TABLE 1

| | Example | | Comparative Examples | | |
|---|---|---|---|---|---|
| | 1 | 2 | 1 | 2 | 3 |
| Primer | A | A | A | A | A |
| Sealing material | A-1 | A-4 | A-2 | A-3 | Nil |
| Salt spray tests | | | | | |
| 1000 hrs | No change | No change | Blistering | Remarkable initial foaming; white rust formed | White rust formed |
| 4000 hrs | No change | No change | Peeling | White rust formed | White rust formed |

| | Example | Comparative Example | | |
|---|---|---|---|---|
| | 3 | 4 | 5 | 6 |
| Primer | B | B | B | B |
| Sealing material | B-1 | B-2 | B-3 | Nil |
| Salt spray tests | | | | |
| 1000 hrs | No change | Blistering | Remarkable initial foaming; white rust formed | White rust formed |
| 4000 hrs | No change | Peeling | White rust formed | White rust formed |

What is claimed is:

1. A method for sealing a zinc-aluminum pseudo alloy spray coating, which comprises forming a zinc-aluminum pseudo alloy spray coating on a substrate, wherein said zinc-aluminum pseudo alloy spray coating comprises randomly distributed zinc particles and aluminum particles, and then sealing a surface of the zinc-aluminum pseudo alloy spray coating with a chromium-free sealing material containing phosphoric acid in an amount of from 0.1 to 7 wt %.

2. The method for sealing a zinc-aluminum pseudo alloy spray coating according to claim 1, wherein a primer containing solid particles, is coated on the substrate prior to forming said zinc-aluminum pseudo alloy spray coating, to form a primer layer and the zinc-aluminum pseudo alloy spray coating is formed on the primer layer.

3. The method for sealing a zinc-aluminum pseudo alloy spray coating according to claim 1, wherein the zinc-aluminum pseudo alloy spray coating is formed to have a weight ratio of Zn/Al of from 90/10 to 50/50 by means of a depressurized arc spraying machine.

4. The method for sealing a zinc-aluminum pseudo alloy spray coating according to claim 1, wherein the sealing material contains phosphoric acid in an amount of from 0.0 to 7 wt % and a binder selected from the group consisting of cationic emulsion resins and butyral resins.

* * * * *